United States Patent [19]

Sugimoto et al.

[11] Patent Number: 4,920,836

[45] **Date of Patent: * May 1, 1990**

[54] TWO BLADE TYPE IMPULSE WRENCH

[75] Inventors: Tadakatsu Sugimoto; Yoshiaki Igarashi; Shiro Saito; Eiichi Wada; Keiji Murai, all of Osaka, Japan

[73] Assignee: Yokota Industrial Co., Ltd., Osaka, Japan

[ * ] Notice: The portion of the term of this patent subsequent to Aug. 30, 2005 has been disclaimed.

[21] Appl. No.: 196,948

[22] Filed: May 20, 1988

Related U.S. Application Data

[62] Division of Ser. No. 937,108, Dec. 2, 1986, Pat. No. 4,766,787.

[51] Int. Cl.[5] ..... B25B 19/00

[52] U.S. Cl. ..... 81/463; 81/465; 178/93.5

[58] Field of Search ..... 81/465, 464, 463, 466, 81/470; 173/93, 93.5

[56] References Cited

U.S. PATENT DOCUMENTS 4,553,948 11/1985 Tatsuno ..... 173/93.5

4,766,787 8/1988 Sugimoto et al. ..... 81/463

*Primary Examiner*—Frederick R. Schmidt

*Assistant Examiner*—Lawrence Cruz

*Attorney, Agent, or Firm*—Koda & Androlia

[57] ABSTRACT

This invention relates to an impulse wrench which has two blades but generates only one impact pulse on the main shaft per one rotation of a liner. In this invention, a liner has at least four seals and a main shaft has at least two seals. And the shape of both or one of the two seals out of at least two seals of main shaft is other than a linear shape parallel to the axial center.

If both of said two seals of main shaft are in said shape, two of at least four seals of liner are in the same shape. The other seals of liner are in a linear shape parallel to the axial center.

If one of said two seals of main shaft is in said shape, one of at least four seals of liner is in the same shape as this. All of the other seals of liner are in a linear shape parallel to the axial center.

In this way, said two seals of liner and said two seals of main shaft coincide with each other only once per one rotation of the liner.

6 Claims, 10 Drawing Sheets

TWO BLADE TYPE IMPULSE WRENCH

This is a division of application Ser. No. 937,108, filed Dec. 2, 1986, now U.S. Pat. No. 4,766,787.

BACKGROUND OF THE INVENTION

1. Field of the Invention

This invention relates to a two-blade type impulse wrench, and more particularly to an impact pulse generating mechanism of two-blade type impulse wrench.

2. Prior Art

Recently, an impulse wrench which transduces an impact power of oil pressure to a tightening torque is often used to tighten bolts and nuts. And presently an impulse wrench which has a plurality of driving blades to generate impact pulses has been developed. But such an impulse wrench had a defect that the tightening torque per an impact pulse was small. It is due to the weakening of inertial force of rotating liner since the number of impact pulses generated in one rotation of liner increases when the number of blades is increased.

And in an impulse wrench, generally, since the output is small for its heavy weight, the motor and hydraulic pulse generator must be increased in capacity in order to obtain a high tightening torque. Accordingly, such impulse wrench having plural blades is forced to be heavier in weight to get prescribed tightening torque, which was a serious burden for the operator.

More recently an impulse wrench which generates only one pulse per one rotation of liner, despite having two blades, has been devised (the Japanese Unexamined Utility Model Publication Sho. No. 59-140173). In this two-blade impulse wrench, two confronting linear-shaped seals formed on the inside wall of liner are deflected by several degrees from the line running through the center of a liner space, while two linear-shaped seals formed between two blades of main shaft on the symmetrical positions against the center of main shaft are deflected from the line running through the center of main shaft by the same degrees as that of the liner space.

In this two-blade type impulse wrench, however, since both of the seals formed on the inside wall of liner and on main shaft are deflected, the volumes of two high pressure compartments of four compartments which are formed when torque is generated are slightly different from each other, and the weight balance in rotation is broken due to the difference in the amount of pressure acting on the blades, which caused a rotary vibration.

BRIEF SUMMARY OF THE INVENTION

In the light of this situation, it is hence a primary object of this invention to offer a two-blade type impulse wrench which does not generate rotary vibration.

It is other object of this invention to present a two-blade type impulse wrench having a small rotary resistance.

It is still other object to offer a two-blade impulse wrench which is easy to manufacture and at the same time generates a greater torque compared with a conventional impulse wrench of a same size.

Corresponding to said objects of this invention, a first characteristic of this invention relates to a two-blade type impulse wrench which comprises a liner rotated by a motor, a main shaft inserted in the liner to be rotatable coaxially therewith, and two blades inserted to be retractable respectively into two grooves formed in the main shaft with their outer ends abutting against the inside wall of said liner, being intended to generate an impact pulse on said main shaft when said liner rotates and seals formed on the inside wall of said liner coincide with the seals formed on the outside wall of said main shaft and the outer ends of said blades, in which said liner has at least four seals formed on its inside wall. And said main shaft has at least two seals formed between said two blades on the outside wall. Two seals of at least four seals of said liner and two seals of at least two seals of said main shaft are all in a same shape, which is a shape other than a linear shape parallel to the axial center. Then the same two seals of said liner and the same two seals of said main shaft coincide with each other only once per one rotation of said liner.

That the seals of the liner and of the main shaft are in a shape other than a linear shape parallel to the axial center means, although these seals are usually in a linear shape parallel to the axial center of the liner and main shaft, that they are not formed in such a linear shape parallel to the axial center. For example, it means to form the seals running along the plane parallel to the axial center in a linear shape inclined against the axial center, a linear shape bending in a V-form or in a W-form, a linear shape curved in an arc form or in an S-form, or a linear shape bending at right angle more than once up and down on the way like stairs.

Moreover, said seals made in a shape other than a linear shape parallel to the axial center are all formed in the same shape so as to be overlapped with each other in such a state that said seals of liner and main shaft contact with each other.

By thus composing, despite that two seals of liner formed in a shape other than a linear shape parallel to the axial center pass through the two seals of main shaft formed in the same shape twice per one rotation of liner, only one impact pulse can be generated. Because these four seals are so formed as to be overlapped with each other and totally coincide with each other only when the seals contact with each other for the first time, so that the four seals contacting with each other for the second time after a half rotation of liner are in the opposite shape to each other, then the two seals confronting at two points can not totally coincide with each other.

In this impulse wrench, the liner and the main shaft are coaxial, and the compartments formed by being divided from the seals formed on them and the outer ends of the blades are equal in size. Accordingly, as the high pressure compartments which are compressed at the time of generating torque are equal in volume, the pressures generated in each high pressure compartment are equal with each other so that the weight balance of the liner is stable and rotary vibration may not be generated. This produces a great effect on the counter-measure against finger injuries from a view point of labor sanitation. In addition, there is no need of deflecting seals of either liner or main shaft, which contributes to ease of manufacturing. In this impulse wrench, moreover, as hydraulic pressure operates equally on two blades, the inertial force of the rotating liner strengthens, and strong hammering torque can be gained. Therefore the tightening torque increases by 30 to 50%.

A second characteristic of this invention relates to a two-blade type impulse wrench which comprises a liner rotated by a motor, a main shaft inserted in the liner to be rotatable coaxially therewith, and two blades inserted to be retractable respectively into two grooves formed in the main shaft with their outer ends abutting against an inside wall of said liner, being intended to generate an impact impulse on said main shaft when seals formed on the inside wall of said liner coincide, in rotation of said liner, with seals formed on the outside wall of said main shaft and the outer ends of said blades, wherein said liner has at least four seals formed on the inside wall, and said main shaft has at least two seals formed between said two blades on the outside wall which are the same as the two-blade impulse wrench of said first characteristic. But the impulse wrench of the second characteristic is different from the one of the first characteristic in that one of the two seals out of at least four of said liner is in a linear shape parallel to the axial center and at the same time, one of the two seals out of at least two of said main shaft is in a linear shape parallel to the axial center of the main shaft. Besides, the other one of two seals of said liner and the other one of two seals of said main shaft are, similar to those of the two-blade type impulse wrench of the first characteristic, in the shape other than the linear shape parallel to the axial center.

By thus composing, by the same reasons of the two-blade impulse wrench of the first characteristic of this invention, only one impact pulse can be generated per one rotation of the liner.

In the two-blade type impulse wrench of the second characteristic, as one of the two seals each of said liner and said main shaft is in a linear shape parallel to the axial center, if these seals coincide with each other, the force toward the axial center (thrust) becomes half. Hence rotary resistance also diminishes. Moreover there is no need of deflecting the seals of the liner and the main shaft and, since the high pressure compartments compressed at the time of generating torque are all equal in volume, pressures generated at two blades are equal, just as in the case of the impulse wrench of the first characteristic.

DETAILED DESCRIPTION OF THE INVENTION

Embodiments of this invention are described hereinafter while referring to the appended drawings.

Figure 1:
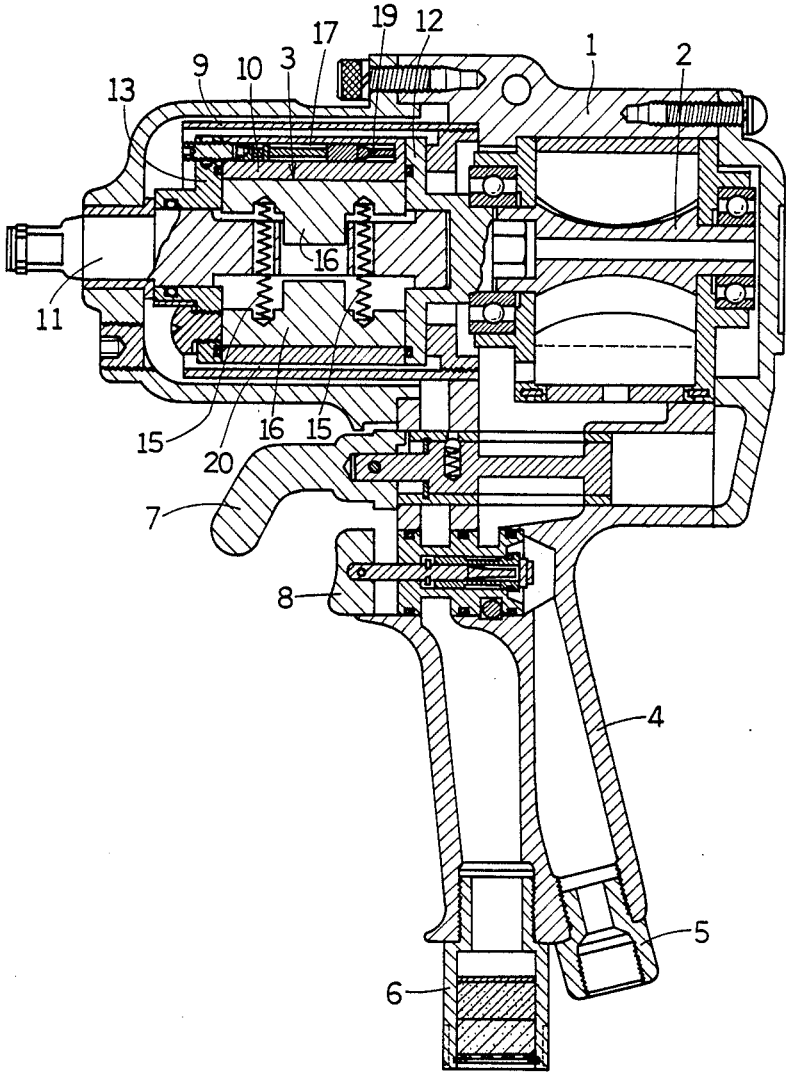
FIG. 1 is a sectional view of a two-blade type impulse wrench.

In FIG. 1, numeral 1 is a main body, 2 is a motor rotated by compressed air, 3 is a hydraulic pulse generator transducing rotary power of the motor 2 into impact pulse by oil pressure, and 4 is a handle. At the bottom of the handle 4, an air intake port 5 for supplying compressed air into the motor 2 and an exhaust port 6 are provided, and at the top, a normal/reverse rotation changeover valve 7 and a throttle lever 8 are installed.

Said hydraulic pulse generator 3 comprises a liner 10 in a liner case 9, a main shaft 11 inserted in the liner 10 with the liner 10 being rotatable against the main shaft 11, and the liner 10 is filled with working fluid for generating torque, and air-tightened with a liner upper plate 12 and a liner lower plate 13 placed at both ends of the liner 10. The liner case 9 and the liner 10 are connected with each other and rotated by the rotation of motor 2.

The liner 10 possesses in its inside, as shown in FIG. 5*a* to FIG. 5*d*, a cylindrical liner space with a nearly elliptical section. The main shaft 11 has two grooves 14 running along the axial center at the symmetrical position against the axial center, and between these grooves 14 are inserted two blades 16 respectively with springs 15 between them. When the liner 10 rotates relatively against the main shaft 11, both blades 16 slide with their outer ends always abutting against the inside wall of the liner space of a nearly elliptical section.

Figure 2:
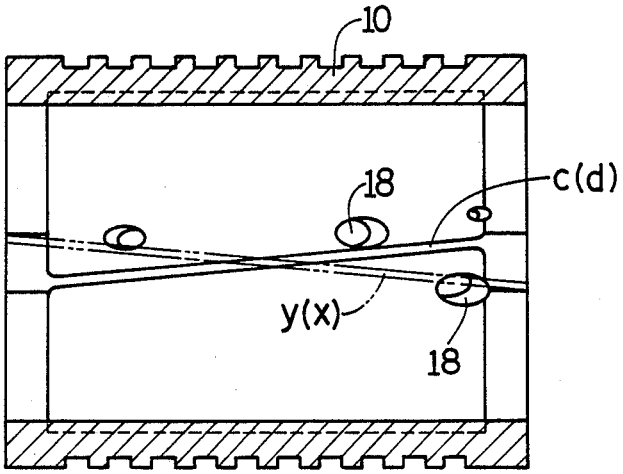
FIG. 2 to FIG. 4 show a first embodiment of this invention, FIG. 2 being a sectional view of a liner, FIG. 3 being a perspective view of a main shaft, and FIG. 4 being a side elevation.
Figure 3:
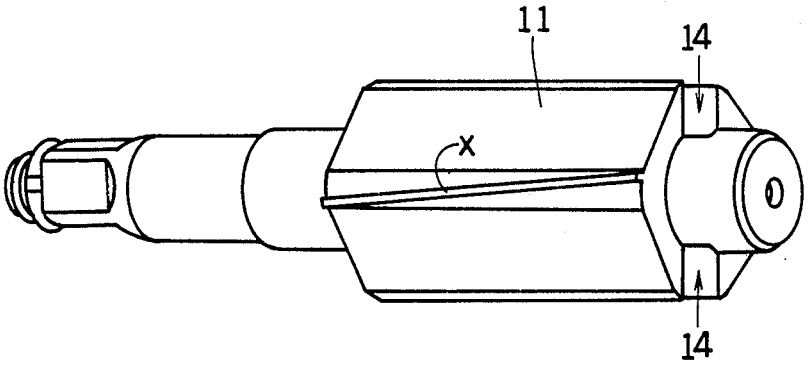
Figure 4:
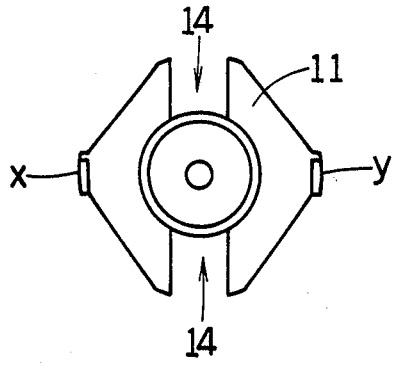

FIG. 2 to FIG. 4 show the liner 10 and the main shaft 11 in the first embodiment of this invention. In this embodiment, two planes are formed parallel to the axial center on the outside wall of the main shaft 11 in the positions rotated by 90° around the axial center from two grooves 14. On each one of these planes, a projection is formed, as shown in FIG. 4, which inclines toward the same direction by the same degrees. The projected edges are the seals x and y.

On the inside wall of the liner 10, at the positions corresponding to the ends of major axis and minor axis of a nearly elliptical seaction, four angle-shaped projections raised up toward the inner direction are formed along the axial center. Two projections on the major axis side are parallel to the axial center of the liner 10, with both edges used as seals a and b. While two projections on the minor axis side are formed along the plane parallel to the axial center of the liner 10 inclined against the axial center, with the direction and degree of the inclination being the same as those of the main shaft 11 . These inclined two projected edges are seals c and d.

As the main shaft 11 is inserted in the liner 10, with both axial centers coinciding (coaxially), when inclined seals x and y of the main shaft 11 and inclined seals c and d of the liner 10 coincide respectively, these inclining directions coincide with each other, so that seals c, d, x and y coincide throughout the overall length. At this moment, the seals a and b and the outer edges of two blades 16 coincide throughout the overall length. Accordingly, at this time, the liner space is sealed airtightly at all seals a, b, c and d so that it is divided into four compartments.

The liner 10 has an output regulating valve insertion hole 17 pierced near the seal c in parallel to the axial center and also possesses two guide holes 18 communicating two compartments at both sides of the seal c with the insertion hole 17. In this insertion hole 17 is an output regulating valve inserted. And at the symmetrical position of the insertion hole 17 against the axial center of the liner 10, a weight balance hole 20 is pierced to keep the weight balance with the insertion hole 17.

Next, the operation of thus composed impulse wrench is described.

When compressed air is supplied into the motor 2 by the operation of throttle lever 8, the motor 2 rotates at high speed, which causes the linear case 9 and the liner 10 to rotate. With no load on, the main shaft 11 also rotates but otherwise the main shaft 11 stops rotating and only the liner case 9 and the liner 10 continue rotating.

The changes in the liner space accompanying the rotation of liner 10 when the main shaft 11 stops rotating as being loaded are described in FIG. 5*a* to FIG. 5*d*. The drawings show the state of liner 10 rotated by 90° each.

Figure 5A:
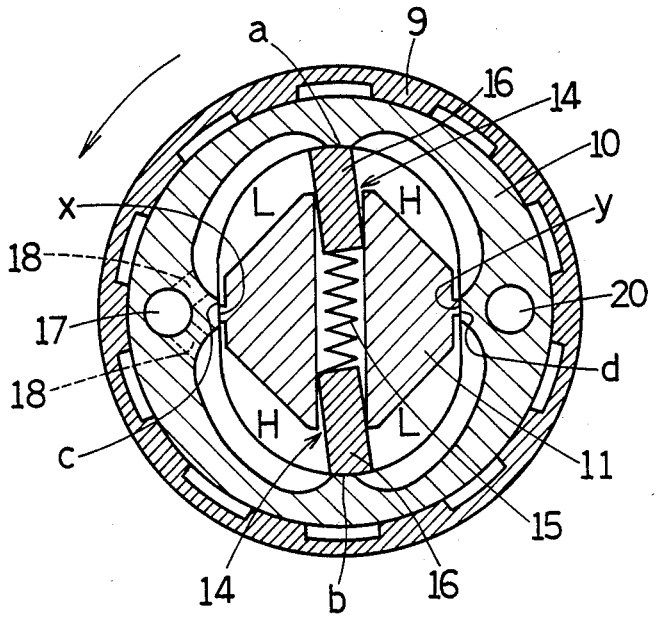
FIG. 5*a* to FIG. 5*d* are sectional views of a hydraulic pulse generator, each drawing showing changes of state in liner housing during one rotation of the liner.

FIG. 5*a* shows the state of generating a hammering power by impact pulse on the main shaft 11. In this state, the seals a, b, c and d of the liner 10 coincide with the seals x and y of the main shaft 11 and the outer ends of blades 16 throughout the overall length so as to divide the liner space into four compartments temporarily and form high pressure compartments H and low pressure compartments L at both sides of two blades 16.

When the liner 10 rotates further by the rotation of the motor 2, as the volume of the high pressure compartment H decreases, the working fluid is instantaneously compressed to generate high pressure, which pushes the blade 16 toward the low pressure compartment L side. Accordingly, a strong torque is generated on the main shaft 11 instantaneously by the action of a couple of force through two blades 16.

Figure 5B:
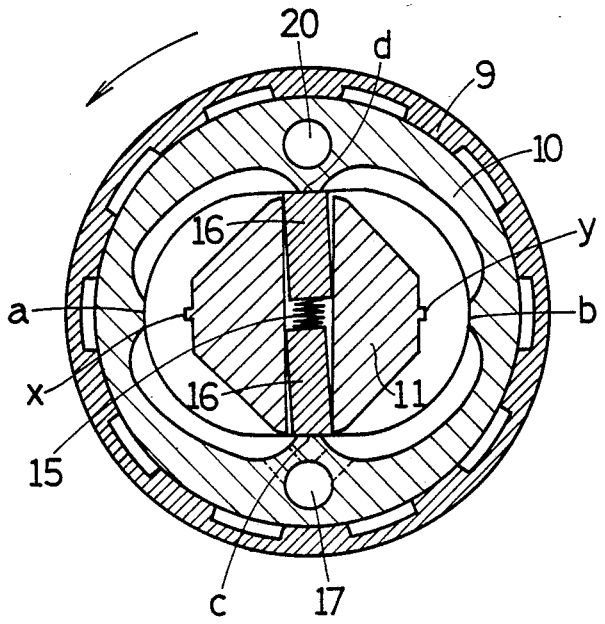

FIG. 5*b* shows the state of the liner 10 rotated by 90° after generating torque. The high pressure compartments H and the low pressure compartments L, formed on both sides of seals x and y, are communicated to make the liner space into one compartment, so that torque is not generated while the liner 10 continues rotation by the motor 2.

Figure 5C:
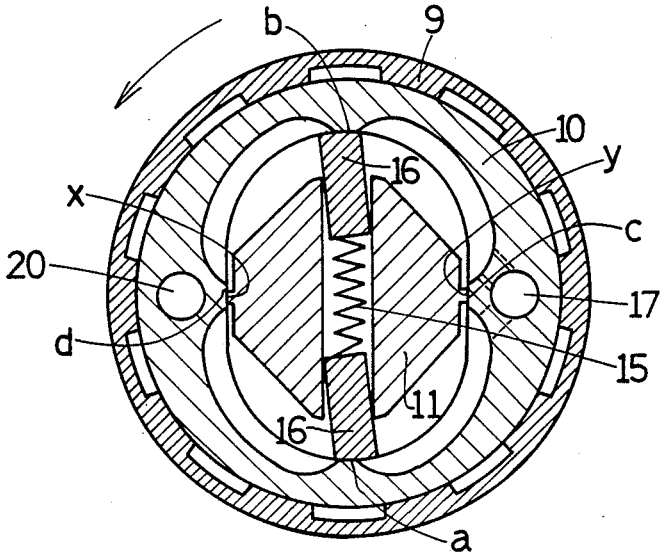

FIG. 5*c* is the state rotated by further 90° from the state of FIG. 5*b*, that is, a state of rotation by 180° from the hammering point. At this point, the seal c confronts with the seal y, and seal d with seal x respectively, but the inclined directions of the seals are opposite to each other and the seals intersect in an X shape as shown in FIG. 2. Then these seals cannot seal airtightly, thus neither pressure change occurs nor torque is generated. The liner 10 keeps rotating.

Figure 5D:
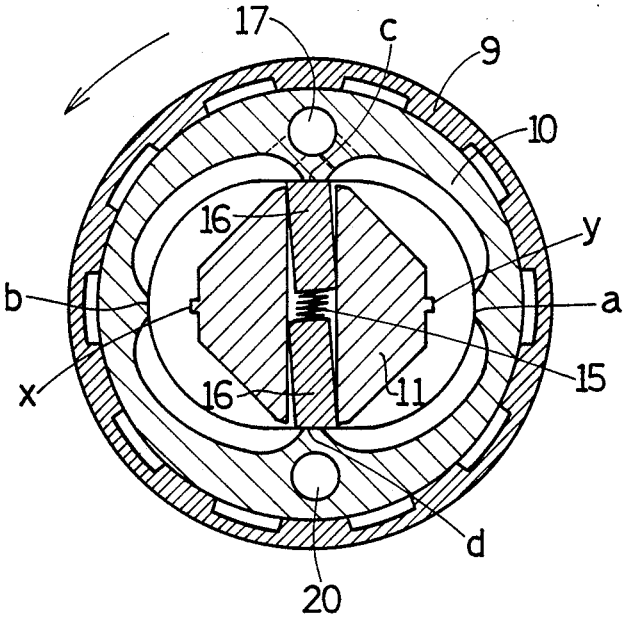

FIG. 5*d* is the state after rotating by further 90° from the state of FIG. 5*c*, that is, by 270° from the hammering point. This state is substantially the same state as that of FIG. 5*b* and no torque is generated.

After rotating further from the state of FIG. 5*d*, it returns to the state of FIG. 5*a*, then seals c and x, and seals d and y coincide with each other to form the high pressure compartments H and the low poressure compartments L as stated above and to generate hammering power again.

In this way, though having two blades, only one hammering power can be generated by one rotation of the liner 10.

Figure 6:
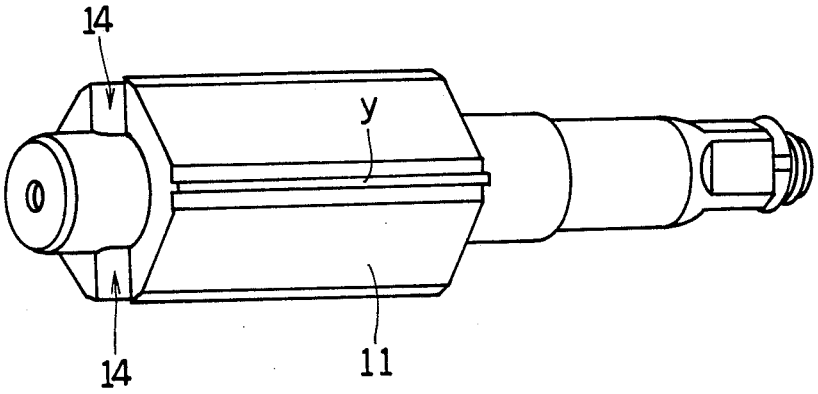
FIG. 6 to FIG. 9 show a second embodiment of this invention, FIG. 6 being a perspective view of a main shaft, FIG. 7 being a side elevation of the main shaft, FIG. 8 being a drawing showing the intersecting state between a seal c of the liner and a seal y of the main shaft in FIG. 5*c*, and FIG. 9 being a drawing showing the intersecting state between a seal d of the liner and a seal x of the main shaft in FIG. 5*c*.
Figure 7:
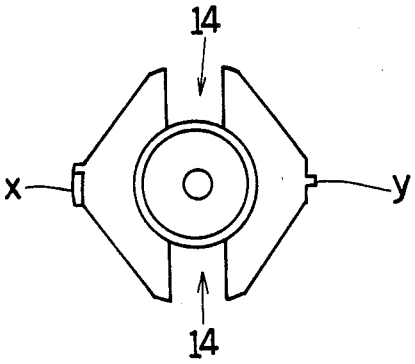

FIG. 6 to FIG. 9 describe the second embodiment of this invention. In this embodiment, one out of two projections formed on the outside wall of the main shaft 11 is inclined (see FIG. 3) same as the first embodiment, whereas the other one is, as shown in FIG. 6, in a linear shape parallel to the axial center of the main shaft 11. Therefore one seal x is inclined against the axial center similarly to the first embodiment, but the other seal y is in parallel to the axial center.

Figure 8:
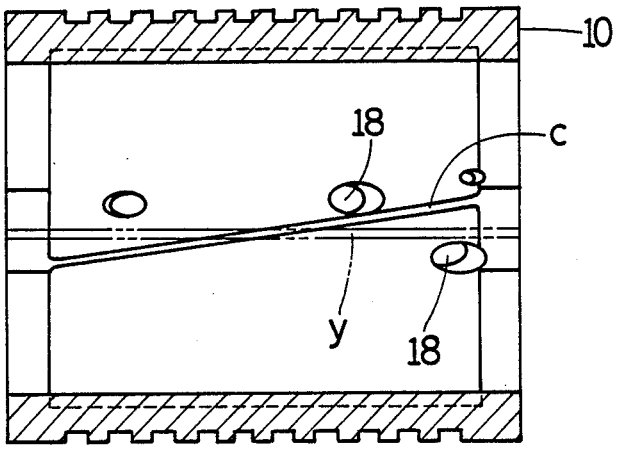
Figure 9:
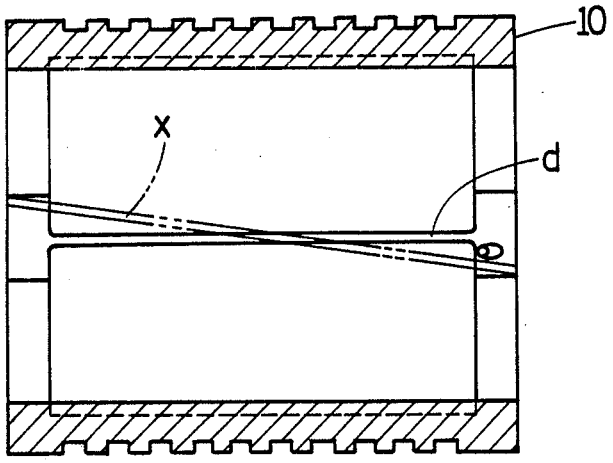

Moreover, as shown in FIG. 8 and FIG. 9, out of four seals a, b, c and d formed on the inside wall of the liner 10, only the seal c on minor axis side is formed inclined in the same direction and by the same degree as the inclined seal x of the main shaft 11, and the other three seals a, b and d are formed in parallel to the axial center.

So in this embodiment, only when inclined seals x and c contact with each other, all seals coincide throughout the overall length to divide the liner space airtightly into four. When the liner 10 rotates by 180° and the seal x comes to contact with seal d, as known clearly by FIG. 8 and FIG. 9, the seals x and d, and seals y and c can not coincide with each other, nor can seal airtightly among them, so that the liner space is divided only into two by two blades 16. Accordingly, also in this embodiment, in spite of this impulse wrench having two blades, only one impact pulse can be generated by one rotation of the liner 10.

Figure 10:
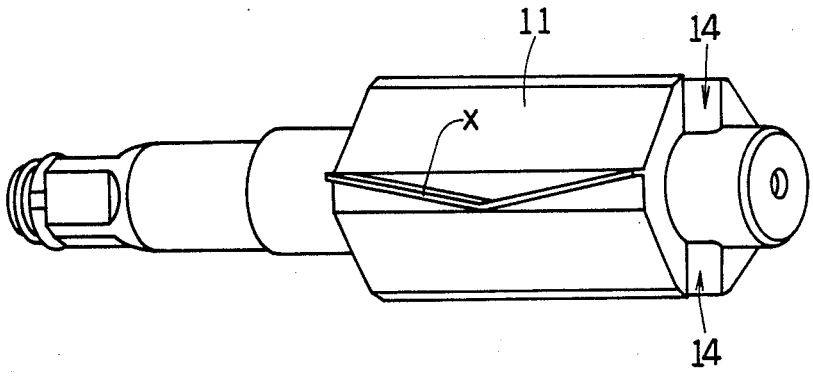
FIG. 10 to FIG. 15 are perspective views of the main shaft showing other embodiments with various shapes of a seal.
Figure 11:
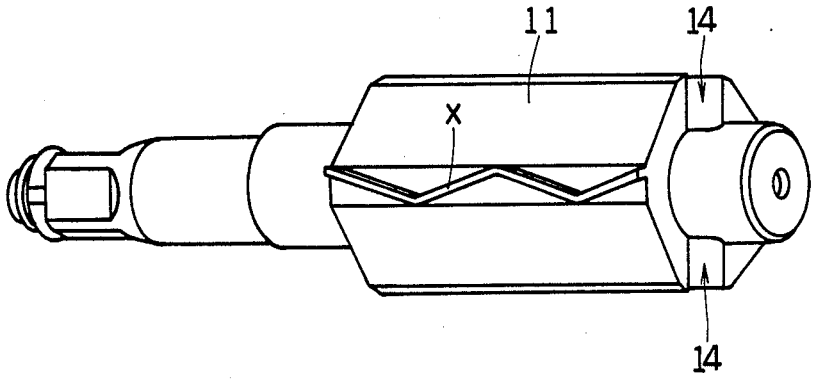
Figure 12:
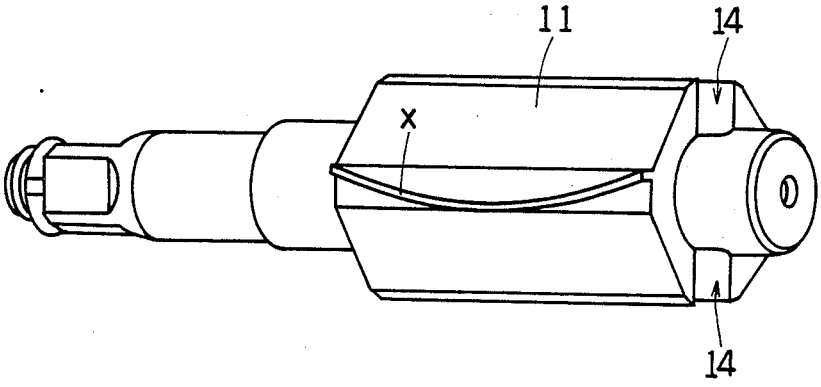
Figure 13:
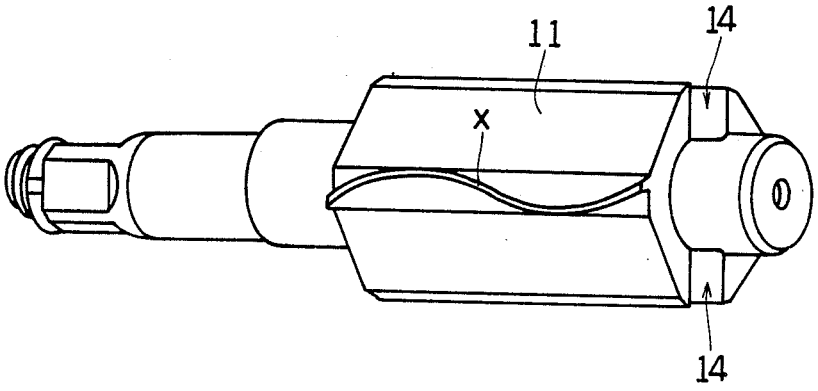
Figure 14:
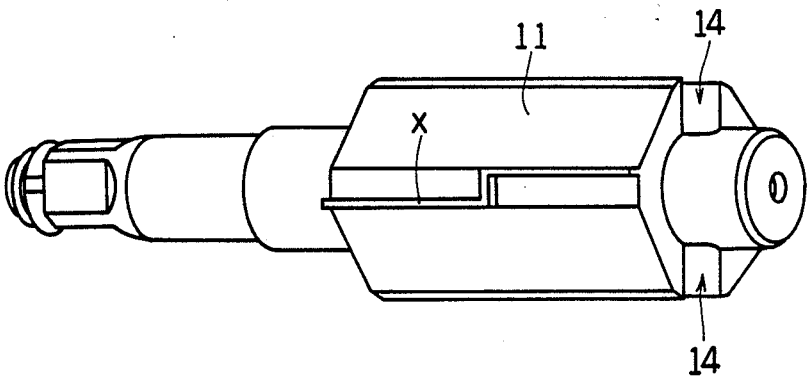
Figure 15:
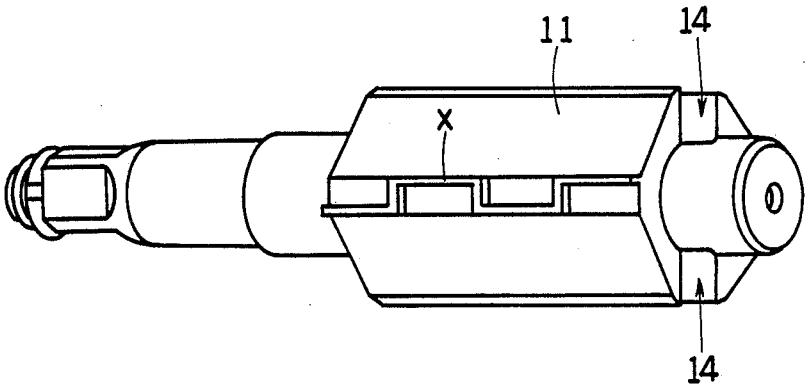

FIG. 10 to FIG. 15 show examples of various shapes of sales x formed on the main shaft 11 other than the inclined linear shape. FIG. 10 is a perspective view of an example of seal x bent in a V shape, FIG. 11 is that bent in a W shape, FIG. 12 is that curved in an arc shape, FIG. 13 is that curved in an S shape (waveform), FIG. 14 is that bent once like stairs at the center, and FIG. 15 is that bent three times up and down like stairs.

In the case that both of the two seals x and y are in the shape other than the linear shape parallel to the axial center, as in said first embodiment, when the seal x is formed in any shape shown in FIG. 10 to FIG. 15, the other seal y is formed in the same shape. Furthermore, only the seals c and d at the minor axis side out of four seals a, b, c and d of the liner 10 should be in the same shape. The seals a and b at major axis side may be in the linear shape parallel to the axial center.

In the case that only one seal x is in the shape other than the linear shape parallel to the axial center of main shaft 11, as in said second embodiment, either one of the seals c and d at the minor axis side of the liner 10 is formed in the same shape as seal x, and the other three seals and the seal y of the main shaft 11 must be in the linear shape parallel to the axial center.

Hereupon in the embodiments above, the numbers of seals of the liner 10 and of the main shaft 11 were at least four and two respectively, but it goes without saying that they may be more than these.

What is claimed is:

1. A two-blade type impulse wrench comprising a liner rotated by a motor, a main shaft inserted in the liner to be rotatable coaxially therewith, and two blades inserted to be retractable respectively into two grooves formed in the main shaft with their outer ends abutting against an inside wall of said liner, being intended to generate an impact pulse on said main shaft when said liner rotates and seals formed on the inside wall of said liner which coincide with seals formed on the outside wall of said main shaft and the outer ends of said blades, wherein said seals formed on the inside wall of said liner comprise at least four seals, and said seals formed on the outside wall of said main shaft and the outer ends of said blades comprise at least two seals, whereas two seals of said at least four seals formed on said liner and two seals of said at least two seals formed on said main shaft are all of a same shape which is other than a single straight line parallel to a rotational axis of said main shaft, so that the same two seals formed on said liner and the same two seals formed on said main shaft coincide with each other only once per rotation of said liner.

2. A two-blade type impulse wrench as set forth in claim 1, wherein said two seals formed on said liner and said two seals formed on said main shaft are of a shape corresponding to a plurality of connected straight line segments wherein at least some of said line segments are not parallel to said rotational axis of said shaft.

3. A two-blade type impulse wrench as set forth in claim 1, wherein said two seals formed on said liner and said two seals formed on said main shaft are sinusoidal shape along a line parallel to said rotational axis of said shaft.

4. A two-blade type impulse wrench comprising a liner rotated by a motor, a main shaft inserted in the liner to be rotatable coaxially therewith, and two blades inserted to be retractable respectively into two grooves formed in the main shaft with their outer ends abutting against an inside wall of said liner, being intended to generate an impact pulse on said main shaft when said liner rotates and seals formed on the inside wall of said liner which coincide with seals formed on the outside wall of said main shaft and the outer ends of said blades, wherein said seals formed on the inside wall of said liner comprise at least four seals, and said seals formed on the outside wall of said main shaft and the outer ends of said blades comprise at least two seals and furthermore one of two seals out of said at least four seals formed on said liner and one of two seals out of said at least two seals formed on said main shaft are in a linear shape along a plane parallel to the rotational axis of said main shaft, and the other one said two seals formed on said liner and the other one of said two seals formed on said main shaft are in a shape other than a straight line parallel to the rotational axis of said main shaft so that said two seals formed on said liner and said two seals formed on said main shaft coincide with each other only once per one rotation of said liner.

5. A two-blade type impulse wrench as set forth in claim 4, wherein the other seal formed on said liner and the other seals formed on said main shaft are of a shape corresponding to a plurality of connected straight line segments wherein at least some of said straight line segments are not parallel to the rotational axis of said main shaft.

6. A two-blade type impulse wrench as set forth in claim 4, wherein the other seal formed on said liner and the other seal formed on said main shaft are sinusoidal shape along a line parallel to the rotational axis of said main shaft.

* * * * *